US008483397B2

(12) United States Patent
Deschamp et al.

(10) Patent No.: US 8,483,397 B2
(45) Date of Patent: Jul. 9, 2013

(54) MULTI-CHANNEL AUDIO DISPLAY

(75) Inventors: Joseph Deschamp, Schwenksville, PA (US); Dave Guerrero, Center Valley, PA (US); Robert Zwiebel, Coopersburg, PA (US)

(73) Assignee: HBC Solutions, Inc., Englewood, CO (US)

( * ) Notice: Subject to any disclaimer, the term of this patent is extended or adjusted under 35 U.S.C. 154(b) by 364 days.

(21) Appl. No.: 12/874,807

(22) Filed: Sep. 2, 2010

(65) Prior Publication Data

US 2012/0057712 A1 Mar. 8, 2012

(51) Int. Cl.
*H04R 29/00* (2006.01)

(52) U.S. Cl.
USPC ..... 381/56; 381/58; 381/306

(58) Field of Classification Search
USPC ..... 381/56–58, 104–107, 306
See application file for complete search history.

(56) References Cited

U.S. PATENT DOCUMENTS

| | | | |
|---|---|---|---|
| 4,691,358 | A | 9/1987 | Bradford |
| 4,768,086 | A | 8/1988 | Paist |
| 5,272,756 | A | 12/1993 | Tanaka et al. |
| 5,619,220 | A | 4/1997 | Tomita et al. |
| 5,751,819 | A | 5/1998 | Dorrough |
| 5,870,484 | A | 2/1999 | Greenberger |
| 6,021,204 | A | 2/2000 | Eastty |
| 6,069,607 | A | 5/2000 | Everett et al. |
| 6,532,024 | B1 | 3/2003 | Everett et al. |
| 6,977,653 | B1 | 12/2005 | Cleary, Jr. et al. |
| 7,555,131 | B2 | 6/2009 | Hollowbush et al. |
| 2005/0042591 | A1 | 2/2005 | Bloom et al. |
| 2005/0226429 | A1 * | 10/2005 | Hollowbush et al. ..... 381/56 |
| 2008/0130918 | A1 * | 6/2008 | Kimijima ..... 381/107 |

OTHER PUBLICATIONS

Application Note entitled, "Monitoring Surround-Sound Audio", Tektronix, Inc. www.tekronix.com/video, (bearing copyright date 2005), pp. 11-18.

* cited by examiner

*Primary Examiner* — Disler Paul
(74) *Attorney, Agent, or Firm* — Tarolli, Sundheim, Covell & Tummino LLP

(57) ABSTRACT

An audio display system can include an audio input configured to receive a plurality of inputs corresponding different audio channels of a multi-channel audio signal. A phase calculator is configured to determine a relative phase between at least a given pair of the audio channels. An amplitude calculator is configured to determine an amplitude for at least the given pair of audio channels. A display generator is configured to generate an audio display. The audio display can include an amplitude element representing the amplitude determined for each audio channel in the given pair of the audio channels, the amplitude elements being spaced apart from each other to define a phase zone between the respective pair of amplitude elements. The audio display can also include a phase output plotted in the phase zone between the respective pair of amplitude elements, the phase output representing a phase relationship between the given pair of the audio channels.

19 Claims, 3 Drawing Sheets

METER GROUP INPUT AND LEVEL

| METER | INPUT | LEVEL |
|---|---|---|
| L | E1 | -29.1 |
| R | E2 | -29.5 |
| C | E2 | -29.6 |
| LS | E1 | -29.4 |
| RS | E2 | -29.6 |

PHASE STATUS

| METER | AVG | MAX | MIN |
|---|---|---|---|
| L-R | 34 | 121 | 7 |
| L-C | 34 | 121 | 7 |
| R-C | 34 | 120 | 6 |
| L-Ls | 34 | 121 | 7 |
| R-Rs | 34 | 121 | 6 |
| Ls-Rs | 34 | 121 | 7 |

MULTI-CHANNEL AUDIO DISPLAY

TECHNICAL FIELD

The present invention relates generally to a display and, more particularly, to a multi-channel display that can present level and phase information for multiple audio channels.

BACKGROUND

Audio production equipment includes meters or readouts whereby an operator can determine various conditions that are pertinent to processing of the signal content, quality and other concerns. The moving display of a meter can provide information that is useful for various purposes and not only for the assurance that there is a signal present. A meter can also provide a visual warning that the signal amplitude may be too high and may potentially cause clipping or distortion by overdriving audio amplifiers. The signal level may be low, potentially introducing hiss. Apart from signal amplitude, meters may be provided as indicators for other parameters, such as frequency spectrum, carrier modulation in a transmitter, etc. In this context, a "meter" might entail any of various changeable indicators such as movable pointers, a variable line of lamps or LEDs, changeable colors, and other indicating techniques.

SUMMARY

The invention relates generally to a display and, more particularly, to a multi-channel audio display and system that can present level and phase information for audio signals.

One aspect of the invention provides an audio display system that includes an audio input configured to receive a plurality of inputs corresponding different audio channels of a multi-channel audio signal. A phase calculator is configured to determine a relative phase between at least a given pair of the audio channels. An amplitude calculator is configured to determine an amplitude for at least the given pair of audio channels. A display generator is configured to generate an audio display. The audio display can include an amplitude element representing the amplitude determined for each audio channel in the given pair of the audio channels, the amplitude elements being spaced apart from each other to define a phase zone between the respective pair of amplitude elements. The audio display can also include a phase output plotted in the phase zone between the respective pair of amplitude elements, the phase output representing a phase relationship between the given pair of the audio channels.

Another aspect of the invention provides a display system. The display system can include at least one input configured to receive a plurality of different signals. A phase calculator is configured to determine a phase relationship between at least one selected pair of the plurality of different signals. A display generator is configured to generate a display. The display can include a display element for each of the plurality of different signals, each of the display elements being spaced apart from each other to define a phase zone between a given pair of the display elements. The display can also include a phase output plotted in the phase zone between the given pair of display elements, the phase output being plotted as a function of time for a sweep period to represent the phase relationship between respective signals represented by the given pair of display elements over the sweep period.

Another aspect of the invention relates to an audio display system that includes an audio input configured to receive a plurality of inputs corresponding to different audio channels of surround sound audio. A phase calculator is configured to determine a phase difference between respective pairs of the audio channels. An amplitude calculator is configured to determine an amplitude level for each of the inputs. A display generator configured to generate an audio display. The audio display can include an amplitude element for each of the audio channels representing the amplitude level determined for each of the audio channels, in which each of the amplitude elements is arranged according to an expected arrangement of surround sound speakers for the audio channels. A phase zone extends between each of the respective pairs of the audio channels. The audio display can also include phase output plotted in the phase zone between at least one given pair of amplitude elements, the phase output being plotted as a function of time for a sweep period to represent the phase difference between respective audio channels represented by the at least one given pair of amplitude elements over the sweep period.

DETAILED DESCRIPTION

The invention relates generally to an audio display and a system for generating an audio display for multi-channel audio. The display visualizes inter-channel phase relationships of surround-sound audio, such as including historical and statistical information of the phase relationships over time. The display provides information that can be utilized to identify and quantify phase errors in connection with surround channels. The display can also visualize audio ballistics, and thus can be used to ascertain that surround channels match in amplitude.

Figure 1:
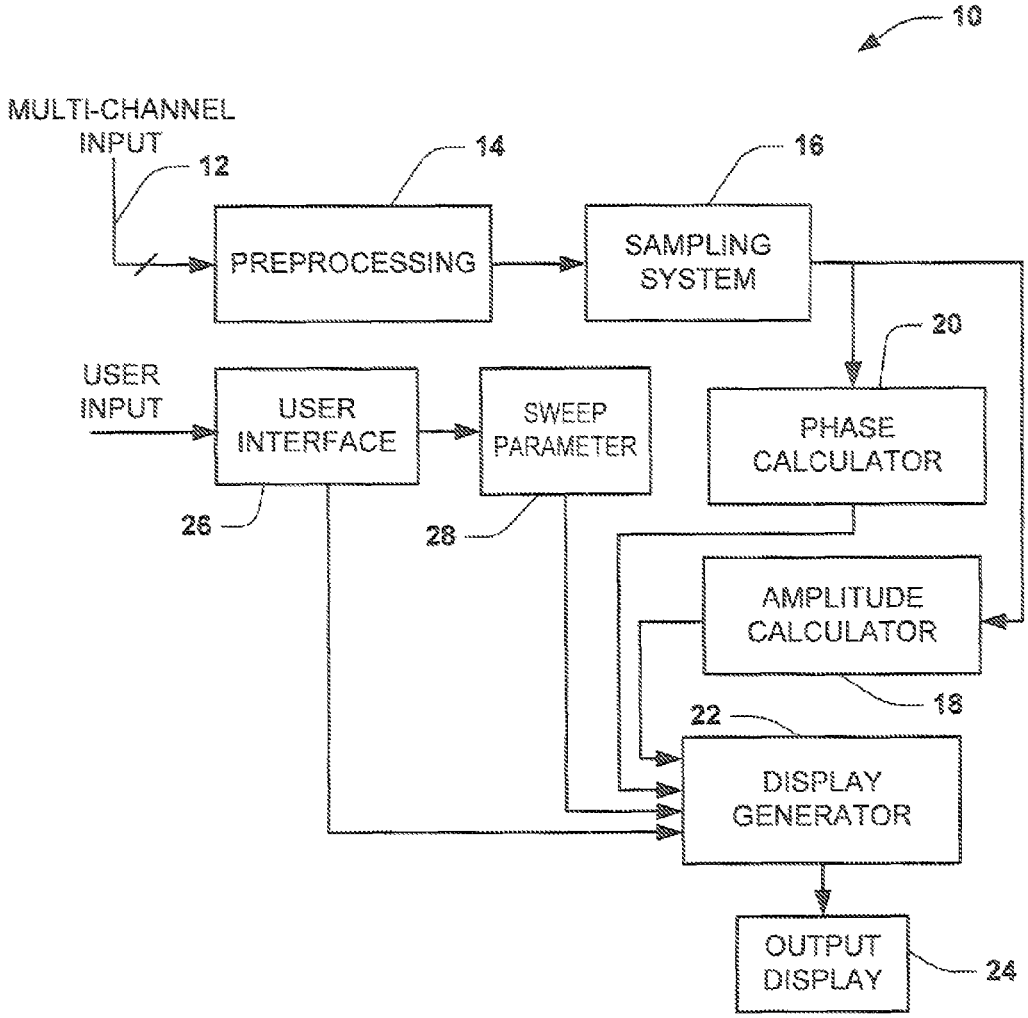
FIG. 1 depicts an example of an audio display that can be implemented according to an aspect of the invention.

FIG. 1 depicts an example of an audio display system 10 that is configured to provide a display of audio information for a plurality of channels of a multi-channel input 12. For instance, the multi-channel input 12 can include two or more input channels (e.g., 3, 4, 5, 6, 7, etc.) corresponding to an audio signal, such as surround sound audio channels. The signals received via the multi-channel input 12 can be encoded according to a variety of standard or proprietary audio technologies, and may be compressed or uncompressed. For instance, the input signal received at 12 can be a serial audio signal, a video program signal or from the output of an analog to digital converter (not shown).

The system includes preprocessing 14 that can be utilized to provide respective digital audio channels based on the signal received at the input 12. The preprocessing can further include filtering, decoding or other techniques to facilitate subsequent processing of the audio channels. A sampling system 16 is configured to sample each channel at a sampling rate and provide corresponding output samples to a phase calculator and an amplitude calculator. For example, the sampling system can provide the output samples at a desired sampling rate, such as about 48 KHz. Each sample on each channel can include one or more byte of digital audio representing the sampled audio signal.

An amplitude calculator 18 is configured to determine an amplitude level for each of the channels based on the output from the sampling system 16. The amplitude calculator thus provides an output having a value for each channel indicative of the amplitude level, such as can be an instantaneous voltage, a root-mean-square (RMS) value, or a running average thereof. For instance, by the amplitude calculator determining the amplitude over a set of successive samples, the appearance of brief peaks can be mitigated. The sample amplitude values can be provided as the amplitude output values for each channel or the values can be converted from amplitude values to dB values on a logarithmic or other scale. The particular form of the output and calculations utilized to determine the amplitude level can be according to one or more standards. As one example, the amplitude calculator 18 can compute a volume-unit value according to one or more of IEC 60268-17 and IEC 60268-10 standards. Other standards or proprietary techniques, including those known and yet-to-be developed, can also be utilized to produce the amplitude outputs for the respective channels.

A phase calculator 20 is configured to determine a phase relationship between pairs of the audio channels. The phase calculator 20 can compute the phase relationship as a phase difference between each pair of the audio channels based on comparing corresponding samples from the sampling system 16.

By way of example, the phase calculator 20 can compare the most significant bits of the samples for each respective pair of channels, the most significant bits representing a positive (0) or negative (1) value in two's complement binary. The most significant bits can be an exclusively-ORed together to ascertain whether the signs are the same (which is interpreted as in phase) or different (out of phase). The precise phase relationship of each respective channel pair can be a potentially complicated mathematical matter that is in part a function of the frequency component at which one assesses the phase relationship. However, by checking the correspondence of the sign values for every sample (or perhaps a statistically relevant sampling of the samples), a variable value is developed that varies together with the phase relationship of all component frequencies for which the sampling rate is high enough to function as an effective Nyquist sample rate. The output of the exclusive OR function can be time-averaged and scaled to provide the phase relationship output for each pair of channels. For instance, the phase difference for each pair of channels can be scaled so that each phase value for each is set in a span between a predetermined minimum value (e.g., 0 degrees) and a predetermined maximum value (e.g., 180 degrees) of phase difference. Those skilled in the art will understand various ranges to which the phase difference values can be scaled. As a further example, the phase calculator can compute the phase outputs according to one or more of the above-identified IEC standards, although other standards or proprietary techniques, including those known and yet-to-be developed, can also be utilized.

A display generator 22 is configured to generate an audio display output based on the amplitude and phase outputs computed by the amplitude calculator 18 and the phase calculator 20. A visualization of the audio display output can be presented to one or more users via an associated output display 24 (see, e.g., FIGS. 2 and 3). The phase and amplitude information from the phase calculator 20 and the amplitude calculator 18 can be stored in memory (e.g., within the display generator or elsewhere in the system) to facilitate generating the display. By storing information, the display generator 22 can provide its output to include historical and statistical phase and amplitude information.

The display generator 22 can generate the output as including amplitude elements that represent the computed amplitude for each channel. The amplitude elements can be spaced apart from each other in a desired spatial orientation, such as described herein. The output can also include the computed phase relationship (e.g., a phase difference) for each pair of audio channels. A phase output for a given pair of channels can be represented as a plot of values that extends generally between the amplitude elements for given pair of channels.

To control how the configuration of the output display as well as the content that is provided on the output display, the system 10 can include a user interface 26 that can be utilized to control the system 10 in response a user input. For instance, the user interface 26 can provide a human-machine interface to set operating parameters for the system 10. The user interface 26 can also be utilized to activate and deactivate the system as well as control other functionality of the system.

In one embodiment, the user interface 26 can be employed to set a sweep parameter 28. The sweep parameter 28 can set a time period (referred to as a sweep period) corresponding to a sampling time interval over which the display generator plots the phase output. In this way, the phase outputs can represent historical trending of the phase relationship between corresponding channels over the sweep period. The sweep period can be set to a default value (e.g., 5 seconds), which can be variable or be fixed. For instance, the sweep parameter 28 can be programmable via the user interface 26. For example, the display generator 22 can plot the points for each sample within the specified sweep period, such that each plot contains both a time and phase value for each sample. The phase that is plotted for each pair of channels can have the same sweep period (e.g., defined by the sweep parameter 28) or different sweep periods may be utilized.

By way of further example, the display generator 22 can present the amplitude information as an elongated amplitude bar for each of the audio channels based on amplitude determined for each of the respective channels. Each of the elongated amplitude bars is spaced apart from each other and spatially arranged relative to each other according to expected locations of speakers for each respective channel. For instance, the amplitude bars can be implemented as spatial line plots or bar graphs of varying length lines extending in radial directions, such that its length corresponds to signal amplitude for each of a plurality of channels—similar to multi-channel VU meter configuration. The phase relationships for a given pair of channels can be plotted (e.g., as a line graph) along a zone extending between the pair of amplitude bars for the given pair of channels, each phase output representing a phase relationship between respective audio channels. The shape and configuration of each zone where phase information is plotted depends on the position and orientation of the amplitude bars.

Figure 2:
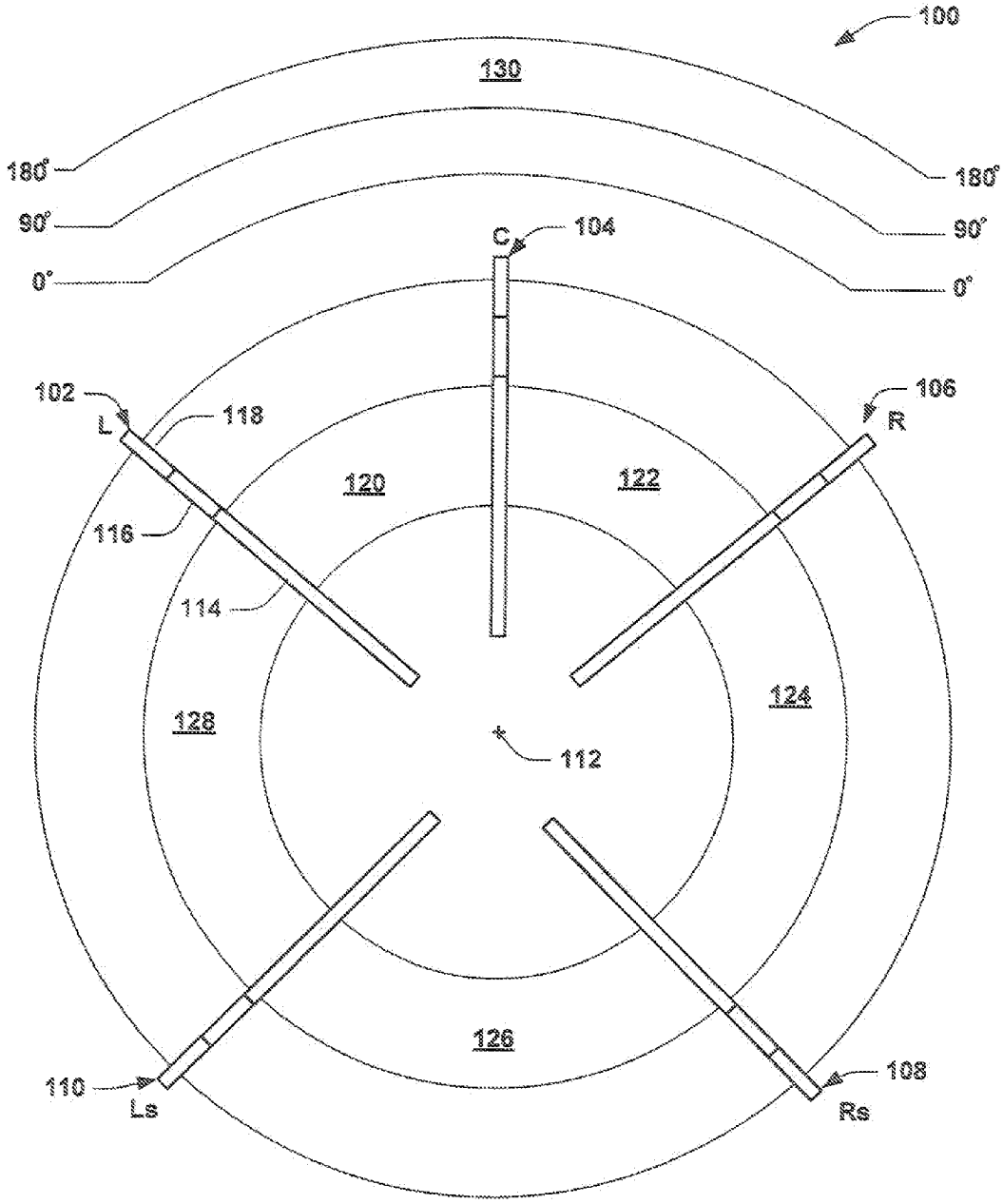
FIG. 2 depicts an example of an audio display that can be implemented according to an aspect of the invention.
Figure 3:
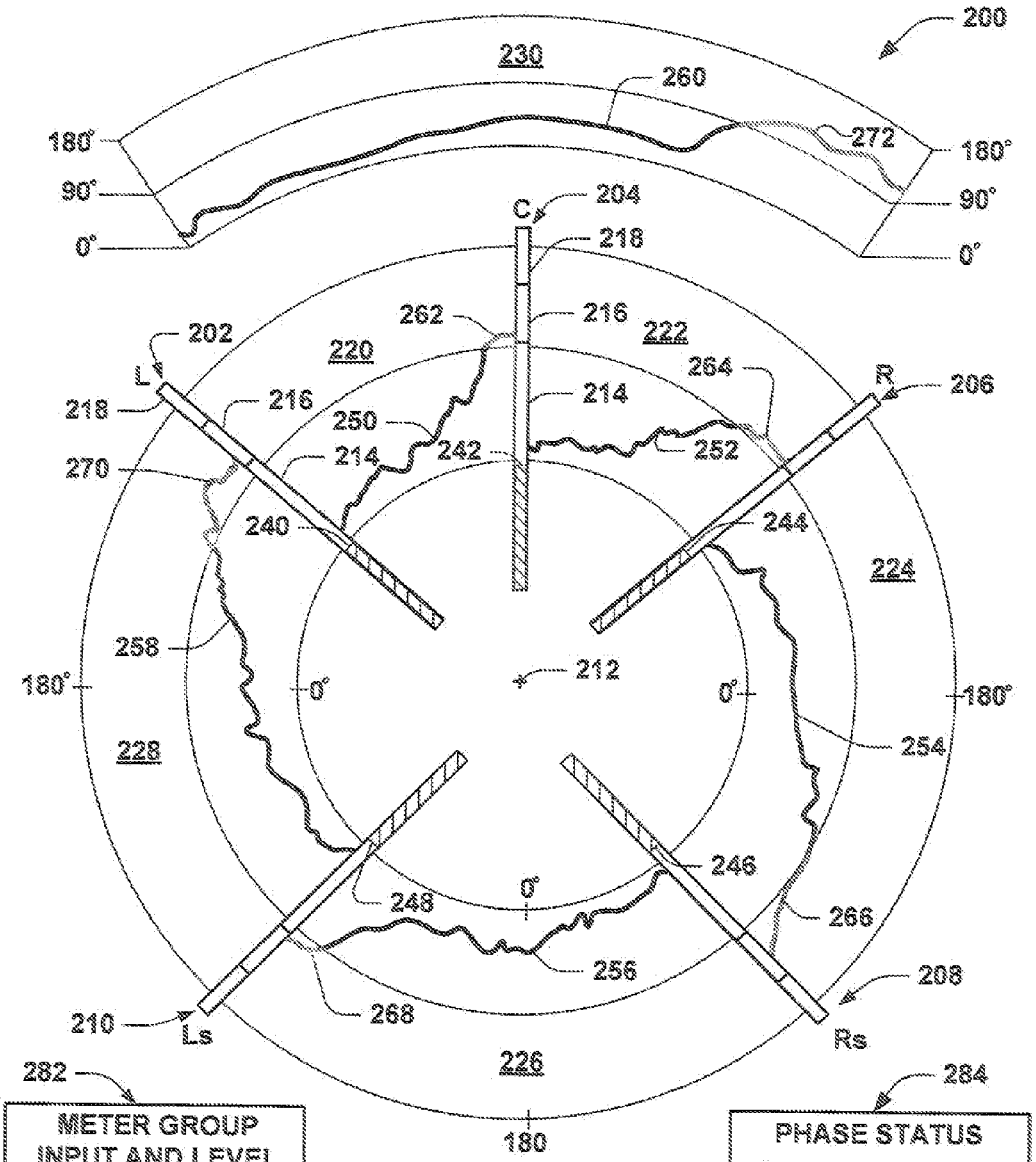
FIG. 3 depicts an example of an audio display system that can be utilized to generate an audio display according to an aspect of the invention.

Example implementations of the output display will be better appreciated with respect to FIGS. 2 and 3. The examples of FIGS. 2 and 3 demonstrate embodiments of audio display for a multi-channel input having five audio channels, namely, a left channel (L), a right channel (R), a center channel (C), a left surround channel (Ls), and a right surround channel (Rs). It will be understood and appreciated that different numbers and configurations of channels can be utilized in other embodiments, which may include a greater or a lesser number of channels. The audio displays of FIGS. 2 and 3 can be implemented on a video display, such as can be integrated into or connected to audio test equipment or other devices configured to process audio input signals, such as shown and described herein.

FIG. 2 depicts an example of an audio display 100 in which audio information can be presented (e.g., on an associated display 24 by the display generator 22 of FIG. 1) for a plurality of audio channels. In the example of FIG. 2, no amplitude or phase information is shown, such as can correspond to each channel being muted or the absence of an input signal. Thus, for purposes of simplicity of explanation, the example of FIG. 2 demonstrates and example layout for the audio display.

The audio display 200 includes a plurality of display elements 102, 104, 106, 108 and 110. In the example of FIG. 2, the display elements 102, 104, 106, 108 and 110 are demonstrated as amplitude elements in the form of elongated bars that extend in a radial direction from a center 112 of the display 100. Thus, the element 102 corresponds to the left channel, element 104 to the center channel, element 106 to the right channel, element 108 to the right surround channel, and element 110 to the left surround channel. Each of the display elements 102, 104, 106, 108 and 110 can be used to graphically present a visualization of amplitude for each respective audio channel. The radially inner end of each bar can correspond to a lower amplitude level and the radially outer end can correspond to a higher amplitude level. Each of the amplitude elements 102, 104, 106, 108 and 110 can also include one or more sections 114, 116, and 118 that can represent different ranges of amplitude for each channel. The ranges can be adjusted by moving a corresponding divider (e.g., a ticker) within the respective amplitude elements.

A sector-shaped zone 120, 122, 124, 126 and 128 extends between respective pairs of amplitude elements 102, 104, 106, 108 and 110. Thus, the zone 120 extends between amplitude elements 102 and 104, zone 122 extends between amplitude elements 104 and 106, zone 124 extends between elements 106 and 108, zone 126 extends between elements 108 and 110, zone 128 extends between elements 110 and 102. Similarly, zone 130 extends between elements 102 and 106, although since these display elements are not adjacent to each other, the arc length of the zone 130 is commensurate with the combination of zones 120 and 122. Additionally, to facilitate readability, the zone 130 is not superimposed over the zones 120 and 122, but instead is positioned outside of (e.g., above) such zones so as not to visually interfere with information being presented.

Similar to the amplitude elements 102, 104, 106, 108 and 110, the zones 120, 122, 124, 126, 128 and 130 can include a scale (e.g., ranging from 0 degrees to 180 degrees) for use in representing phase information that is plotted in each zone. For instance, the computed phase values can be plotted with a radial position in the scale according to its phase value. As mentioned above, the phase information can be plotted as a function of time (e.g., a sweep period). Thus, one end of each zone can correspond to the beginning of the sweep period and the other end of each zone can correspond to the end of the sweep period.

FIG. 3 depicts an example of an audio display 200 that includes one or more representation of amplitude and phase information (e.g., such as can be generated by the display generator 22 of FIG. 1) for multi-channel audio signals. Common elements and features shown and described in FIG. 2 are represented in FIG. 3 by the same reference numbers increased by adding '100.' Briefly stated, the audio display 200 includes a plurality of amplitude elements 202, 204, 206, 208 and 210, such as corresponding elongated bars that extend radially along a circular path. In the example of FIG. 3, each amplitude element 202, 204, 206, 208 and 210 can include a plot of the amplitude determined for the respective channel (e.g., by the amplitude calculator 18 of FIG. 1), as demonstrated by respective bars 240, 242, 244, 246 and 248 via cross-hatching. The radially outer end of each amplitude bar 240, 242, 244, 246 and 248 thus corresponds to a plot of the current amplitude level as determined and scaled by the audio system.

It will be appreciated that the different amplitude ranges 214, 216 and 218 can present amplitude levels in different colors to indicate if the amplitude for each channel is within normal expected levels (e.g., green), slightly above normal levels (e.g., yellow) or exceeds expected levels (e.g., red). These ranges can be set by a user by corresponding controls (e.g., by the user interface 26 of FIG. 1). For instance, a first ticker inside the bar can be utilized to identify the position where a reference level sits, while the red ticker is for the peak level. The amplitude bars 240, 242, 244, 246 and 248 can constantly update with audio levels on channel L, R, C, Ls, or Rs, such as to provide a substantially real-time indication of amplitude.

The audio display 200 also includes zones 220, 222, 224, 226, 228 and 230 for displaying phase relationships (e.g., as determined by the phase calculator 20 of FIG. 1), demonstrated as respective plots 250, 252, 254, 256, 258 and 260. For instance the plot 250 depicts the phase relationship between left and center channels, plot 252 depicts the phase relationship between center and right channels, plot 254 depicts the phase relationship between right and right surround channels, plot 256 depicts the phase relationship between right surround and left surround channels, plot 258 depicts the phase relationship between left surround and left channels, and plot 260 depicts the phase relationship between left and right channels. The span of each zone (e.g., extending as an arc in a clockwise direction) between respective amplitude elements defines a time axis for plotting phase information. The radial position of each point on each phase plot 250, 252, 254, 256, 258 and 260 relative to the scale (e.g., from 0 degrees to 180 degrees) defines a phase value at a given point in time. Thus, for a given sweep period, each of the plots 250, 252, 254, 256, 258 and 260 can be scaled (e.g., fitted) to extend generally between its respective pair of amplitude elements, as depicted in FIG. 3. The phase output corresponding to the plots 250, 252, 254, 256, 258 and 260 can be computed for a plurality of points according to the sweep period. The plurality of points for each plot 250, 252, 254, 256, 258 and 260 can be output such that a value of a given plot 250, 252, 254, 256, 258 and 260 can correspond to a radial position of each point and the time in the sweep period for the value of the given plot 250, 252, 254, 256, 258 and 260 corresponds to an angular position relative to an arc extending between a respective pair of amplitude elements 202, 204, 206, 208 and 210.

Additionally, different ranges of phase information can be represented by different colors depending on the phase values, such as represented by its radial position. For instance, phase values determined to be between 0° and 90° can be plotted in a first color (e.g., green) while phase values between 90° and 180° can be plotted in second color (e.g., red) to emphasize potential phase anomalies or alarm conditions. Thus, in the example of FIG. 3, portions of each phase plot 250, 252, 254, 256, 258 and 260 that is in the range between 90° and 180° has a different color from the portion of the phase plot in the between 0° and 90°, as demonstrated at 262, 264, 266, 268, 270, and 272, respectively. It will be understood that in addition to, or as an alternative to, utilizing different colors, corresponding audio conditions can be represented in different levels of brightness as it nears the edge of a given range. The display 200 can also include a running clock 280 that can the elapsed time since the last reset.

The audio display 200 also can present information in multiple contexts, such as in addition to the graphical display of amplitude and phase. For example, tables can be provided in the display 200 to show channel mapping, audio level, and phase statistics in texts. As one example, the display 200 can include an amplitude table 282 for displaying amplitude information (e.g., as computed by the amplitude calculator 18 of FIG. 1). The amplitude table 282 can provide amplitude information similar to a VU meter that displays amplitude levels for a set of channels (e.g., L, R, C, Ls, and Rs) received at corresponding inputs (e.g., E1, E2, E2, E1 and E2). For instance, the table 282 can provide information for a set of a number of available meters (e.g., for meters 1-8 or for meters 9-16).

Additionally or alternatively, the display can include a phase table 284. The phase table 284 can display phase status for a set of channel pairs, such as to display values of phase information for the channel pairs in each of the phase plots 250, 252, 254, 256, 258 and 260. For instance, the phase status can include an indication of the average, maximum and minimum phase values (e.g., as computed by the phase calculator 20 of FIG. 1).

In view of the foregoing it will be appreciated that the audio display system can be employed to provide an improved surround sound phase display that visualizes inter-channel phase relationship of surround-sound audio. The display can be utilized to show the history and statistics of phase difference over time. Thus, the display provides information to identify and quantify phase errors in connection with surround channels. The display can also present audio ballistics, and thus can be used to check surround channel match in amplitude.

While the displays have been shown and described herein as pertaining to audio signals, it will be understood that the display is not limited to audio signals and can be utilized to provide phase information for other types of signals as may be desired for a given application. Additionally, the displays can also provide other types of information in combination with the displays shown and described herein, such as including one or more windows that provide information for a video signal or a window that displays a corresponding video output.

As will be appreciated by those skilled in the art, portions of the invention may be embodied as a method, data processing system, or computer program product. Accordingly, these portions of the present invention may take the form of an entirely hardware embodiment (e.g., a special purpose computer or an electronic test and/or monitoring apparatus), an entirely software embodiment, or an embodiment combining software and hardware. Furthermore, portions of the invention may be a computer program product on a computer-usable storage medium having computer readable program code on the medium. Any suitable computer-readable medium may be utilized including, but not limited to, static and dynamic storage devices, hard disks, optical storage devices, and magnetic storage devices.

Certain embodiments of the invention are described herein with reference to flowchart illustrations of methods, systems, and computer program products. It will be understood that blocks of the illustrations, and combinations of blocks in the illustrations, can be implemented by computer-executable instructions. These computer-executable instructions may be provided to one or more processor of a general purpose computer, special purpose computer, or other programmable data processing apparatus (or a combination of devices and circuits) to produce a machine configured as the audio display system, such that the instructions, which execute via the processor, implement the functions specified in the block or blocks.

These computer-executable instructions may also be stored in computer-readable memory that can direct a computer or other programmable data processing apparatus (e.g., test apparatus) to function in a particular manner, such that the instructions stored in the computer-readable memory result in an article of manufacture including instructions which implement the function specified in one or more blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in one or more blocks.

What have been described above are examples and embodiments of the invention. It is, of course, not possible to describe every conceivable combination of components or methodologies for purposes of describing the invention, but one of ordinary skill in the art will recognize that many further combinations and permutations of the invention are possible. Accordingly, the invention is intended to embrace all such alterations, modifications and variations that fall within the scope of the appended claims and the application.

What is claimed is:

1. An audio display system, comprising: an audio input configured to receive a plurality of inputs corresponding different audio channels of a multi-channel audio signal; a memory to store computer-executable instructions; and a processor to access the memory and execute the computer-executable instructions, the computer executable instructions comprising: a phase calculator configured to determine a relative phase between at least a given pair of the audio channels; an amplitude calculator configured to determine an amplitude for at least the given pair of audio channels; and a display generator configured to generate data that characterizes an output of an audio display, the output of the audio display comprising: an amplitude element representing the amplitude determined for each audio channel in the given pair of the audio channels, the amplitude elements being spaced apart from each other to define a phase zone between the respective pair of amplitude elements, wherein a given amplitude element of the amplitude elements operates independently of each of the other amplitude elements; and a phase output plotted as a function of time for a sweep period in the phase zone between the respective pair of amplitude elements, the phase output representing a phase relationship between the given pair of the audio channels such that each phase output extends as a time-based plot within its respective phase zone.

2. The system of claim 1, wherein the phase output represents historical trending of the phase relationship between corresponding audio channels over the sweep period.

3. The system of claim 1, wherein the sweep period is programmable.

4. The system of claim 1, wherein the phase output is computed for a plurality of points according to the sweep period, the display generator being configured to generate data that characterizes a plotting of the plurality of points for each phase output, such that a value of the phase output corresponds to a radial position of each point and the time in the sweep period for the value of the phase output corresponds to an angular position relative to an arc extending between the respective pair of amplitude elements.

5. The system of claim 1, wherein the output of the audio display further comprises an amplitude element for each of the audio channels, each amplitude element extending along a radius of a circular region, such that each phase zone comprises a generally circular sector-shaped zone between each adjacent pair of amplitude elements.

6. The system of claim 5, wherein a distance away from a center of the circular region corresponds to the phase value that is plotted.

7. The system of claim 6, wherein the distance away from the center of the circular region increases linearly proportional to a value of the phase output.

8. The system of claim 1, wherein the phase output plotted in the phase zone represents historical and statistical relationships of the given pair of audio channels over a time period.

9. The system of claim 1, wherein the display generator is further configured to provide data characterizing a table containing values that represent at least one of the amplitude and phase relationships.

10. The system of claim 1, wherein the display generator is further configured to provide data characterizing a phase output of the audio display for a pair of non-adjacent channels, corresponding to at least one non-adjacent pair of amplitude elements, the phase output for the pair of non-adjacent channels being plotted as extending between the at least one non-adjacent pair of amplitude elements.

11. The system of claim 1, wherein there are at least four audio channels, and wherein the output of the audio display further comprises an amplitude element for each of the audio channels, each of the amplitude elements being arranged according to an expected spatial arrangement of surround sound speakers for each of the audio channels, such that the phase outputs represent a phase difference between audio channels provided to corresponding pairs of the surround sound speakers.

12. A display system, comprising:

at least one input configured to receive a plurality of different signals;

a memory to store computer-executable instructions; and a processor to access the memory and execute the computer-executable instructions, the computer executable instructions comprising:

a phase calculator configured to determine a phase relationship between at least one selected pair of the plurality of different signals;

a display generator configured to generate data that characterizes an output of a display, the output of the display comprising:

a display element for each of the plurality of different signals, each of the display elements being spaced apart from each other to define a phase zone between a given pair of the display elements; and a phase output plotted in the phase zone between the given pair of display elements, the phase output being plotted as a function of time for a sweep period to represent the phase relationship between respective signals represented by the given pair of display elements over the sweep period;

wherein the phase output is computed for a plurality of points according to the sweep period, the display generator providing data that characterizes a plotting of the plurality of points for each phase output, such that a value of the phase output corresponds to a radial position of each point and the time in the sweep period for the value of the phase output corresponds to an angular position relative to an arc extending between the respective pair of display elements.

13. The system of claim 12, wherein the plurality of different signals comprise different audio channels, and wherein the display element for each of the audio channels comprises an amplitude element for each of the audio channels, each amplitude element graphically representing an amplitude determined for each of the plurality of different signals, each of the amplitude elements operating independently from each other and each of the amplitude elements being spaced apart from each other to define a corresponding phase zone between each pair of amplitude elements.

14. The system of claim 13, wherein each amplitude element comprises an elongated amplitude bar that extends radially with respect to a circular region with an amplitude level being indicated therein, such that each corresponding phase zone comprises a generally circular sector-shaped zone between each adjacent pair of elongated amplitude bars.

15. The system of claim 14, wherein for each phase zone, the phase output is plotted such that a distance away from a center of the circular region corresponds to a value of the phase output that is plotted.

16. The system of claim 13, wherein each of the amplitude elements is arranged according to an expected arrangement of surround sound speakers for each of the audio channels, such that the phase outputs represent a phase difference between audio channels provided to corresponding pairs of the surround sound speakers.

17. The system of claim 12, wherein the display generator is further configured to provide data that characterizes a phase output for a pair of non-adjacent channels, corresponding to at least one non-adjacent pair of display elements.

18. A display system, comprising: an audio input configured to receive a plurality of inputs corresponding to different audio channels of surround sound audio; a memory to store computer-executable instructions; and a processor to access the memory and execute the computer-executable instructions, the computer executable instructions comprising: a phase calculator configured to determine a phase difference between respective pairs of the audio channels; an amplitude calculator configured to determine an amplitude level for each of the inputs; a display generator configured to generate data that characterizes an output of an audio display, the output of the audio display comprising: an amplitude element for each of the audio channels representing the amplitude level determined for each of the audio channels, each of the amplitude elements being arranged according to an expected arrangement of surround sound speakers for the audio channels, a phase zone extending between each of the respective pairs of the audio channels, wherein a given amplitude element of the amplitude elements operates independently of each of the other amplitude elements; and a phase output plotted in the phase zone between at least one given pair of amplitude elements, the phase output being plotted as a function of time for a sweep period to represent the phase difference between respective audio channels represented by the at least one given pair of amplitude elements over the sweep period.

19. The system of claim 18, wherein the display generator is further configured to provide data that characterizes a corresponding phase output for at least one pair of non-adjacent channels, corresponding to at least one non-adjacent pair of amplitude bars, the corresponding phase output being plotted for the sweep period in a zone extending between the at least one non-adjacent pair of amplitude bars.

* * * * *